US010494847B1

(12) United States Patent
Phillip

(10) Patent No.: US 10,494,847 B1
(45) Date of Patent: Dec. 3, 2019

(54) EXTENDABLE TRACK COVER FOR A SLIDING DOOR

(71) Applicant: Steven Phillip, Nantucket, MA (US)

(72) Inventor: Steven Phillip, Nantucket, MA (US)

( * ) Notice: Subject to any disclaimer, the term of this patent is extended or adjusted under 35 U.S.C. 154(b) by 106 days.

(21) Appl. No.: 15/728,600

(22) Filed: Oct. 10, 2017

(51) Int. Cl.
*E05D 15/06* (2006.01)

(52) U.S. Cl.
CPC ..... *E05D 15/0686* (2013.01); *E05Y 2201/10* (2013.01); *E05Y 2201/11* (2013.01)

(58) Field of Classification Search
CPC ..... E05D 15/0686; E05Y 2210/10; E05Y 2210/11
USPC ..... 49/125
See application file for complete search history.

(56) References Cited

U.S. PATENT DOCUMENTS 3,100,918 A 8/1963 Coverley
3,295,587 A * 1/1967 Horgan, Jr. ..... E06B 3/4618 160/91
4,344,648 A 8/1982 Mapp
D271,812 S 12/1983 Markus
4,424,605 A 1/1984 Squires
4,525,953 A 7/1985 Stutzman
4,968,856 A * 11/1990 Bowley ..... H01R 13/447 174/67
5,203,116 A * 4/1993 Chen ..... E05D 15/0621 16/95 R
5,475,948 A 12/1995 Parke
5,673,517 A 10/1997 Stanclift
8,375,516 B2 * 2/2013 Baines ..... E05D 15/0665 16/87.4 R
2008/0078068 A1 4/2008 Cervantes
2013/0042535 A1 2/2013 Fleeting
2017/0089110 A1 * 3/2017 Tavakoli-Targhi ..... B60R 13/0243

FOREIGN PATENT DOCUMENTS

JP 2005-133298 * 5/2005
WO WO 2015/150991 * 10/2015

* cited by examiner

*Primary Examiner* — Gregory J Strimbu
(74) *Attorney, Agent, or Firm* — Kyle A. Fletcher, Esq.

(57) ABSTRACT

The extendable track cover for a sliding door protects the wing track of the sliding door from damage from refuse that may fall into the wing track while the sliding door is in the closed position. The cover is retracted directly onto a spool of a deployment mechanism when the sliding door is opened.

17 Claims, 6 Drawing Sheets

EXTENDABLE TRACK COVER FOR A SLIDING DOOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fixed constructions including window or door fittings for a building, more specifically, an accessory for a sliding or lifting wing.

SUMMARY OF INVENTION

The extendable track cover for a sliding door is configured for use with a sliding door. The sliding door is further defined with a stationary wing, a sliding wing, a wing track, and a door frame. The sliding wing moves in a linear fashion along a single dimension within the wing track. The extendable track cover for a sliding door is a retractable cover that is a semi-rigid structure that covers the wing track of the sliding door when the sliding wing is in the closed position. The extendable track cover for a sliding door protects the wing from damage from refuse that may fall into the wing track while the sliding door is in the closed position. The retractable cover is retracted directly on to a spool when the sliding door is opened. The extendable track cover for a sliding door comprises a cover and a deployment mechanism. The cover is a physical barrier that is positioned over the wing track while the sliding wing is in the closed position. The deployment mechanism: 1) retracts and stores the cover when the sliding wing is moved to the open position; and, 2) deploys the cover back over the wing track when the sliding wing is returned to the closed position.

These together with additional objects, features and advantages of the extendable track cover for a sliding door will be readily apparent to those of ordinary skill in the art upon reading the following detailed description of the presently preferred, but nonetheless illustrative, embodiments when taken in conjunction with the accompanying drawings.

In this respect, before explaining the current embodiments of the extendable track cover for a sliding door in detail, it is to be understood that the extendable track cover for a sliding door is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the extendable track cover for a sliding door.

It is therefore important that the claims be regarded as including such equivalent construction insofar as they do not depart from the spirit and scope of the extendable track cover for a sliding door. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
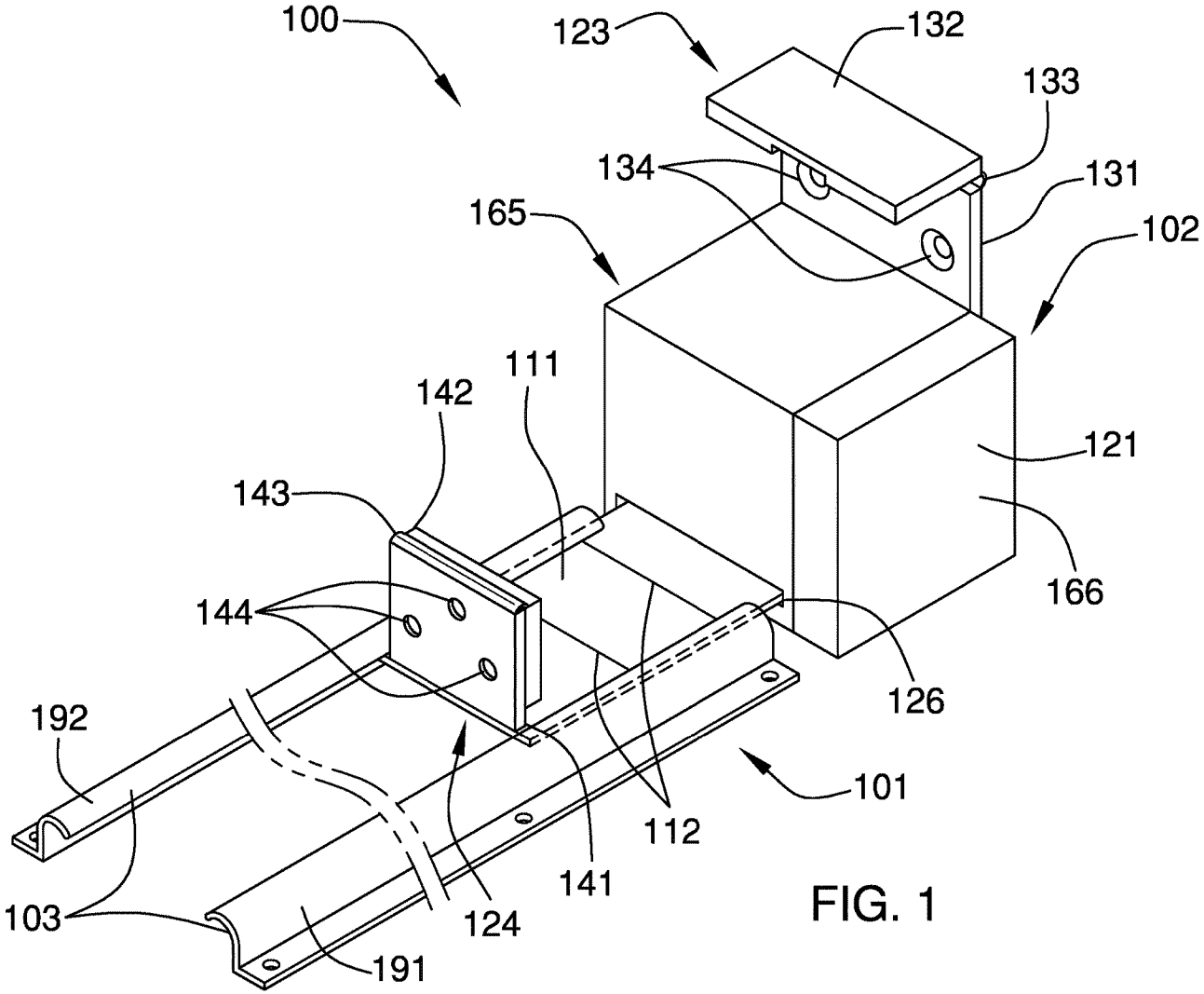
FIG. 1 is a perspective view of an embodiment of the disclosure.
Figure 2:
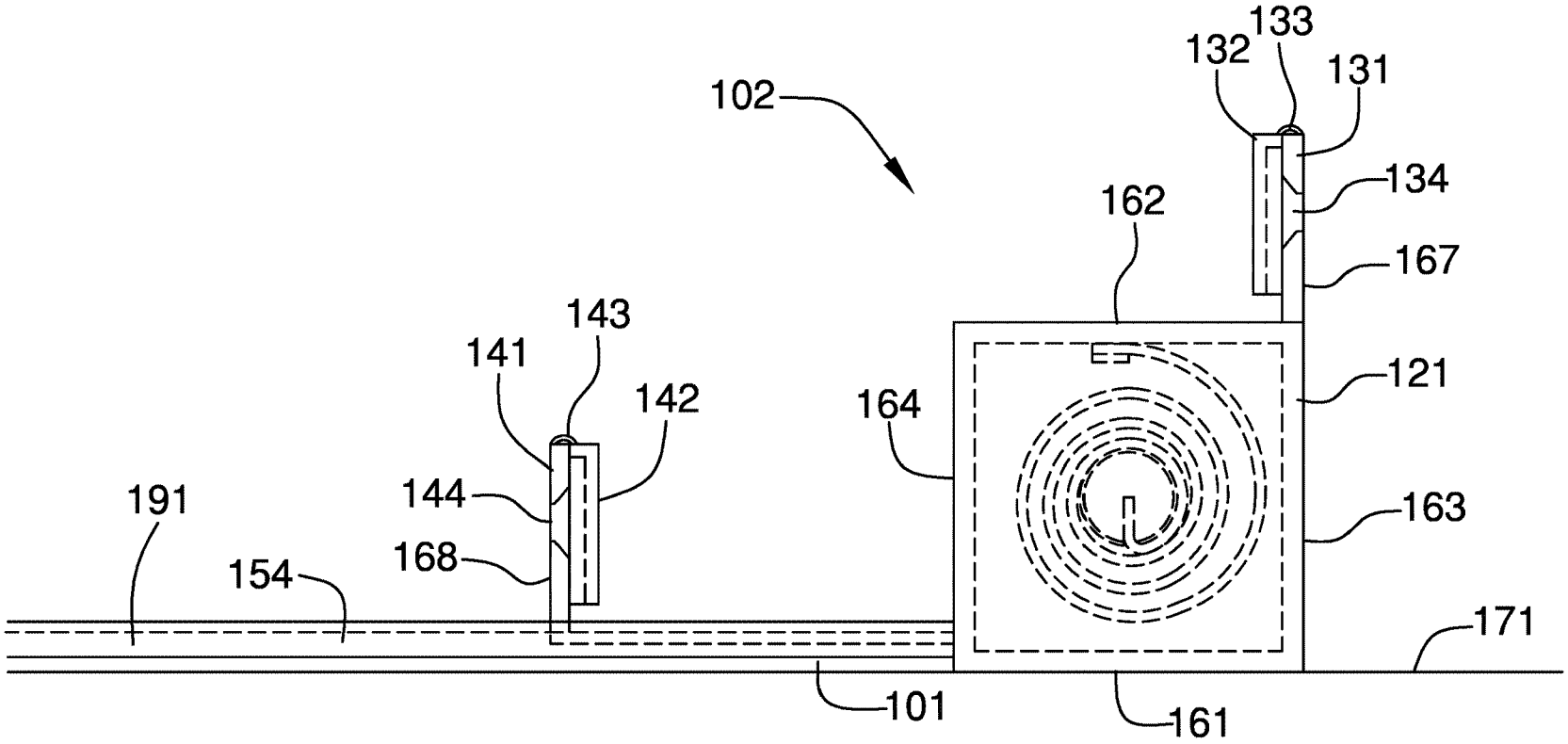
FIG. 2 is a front view of an embodiment of the disclosure.
Figure 3:
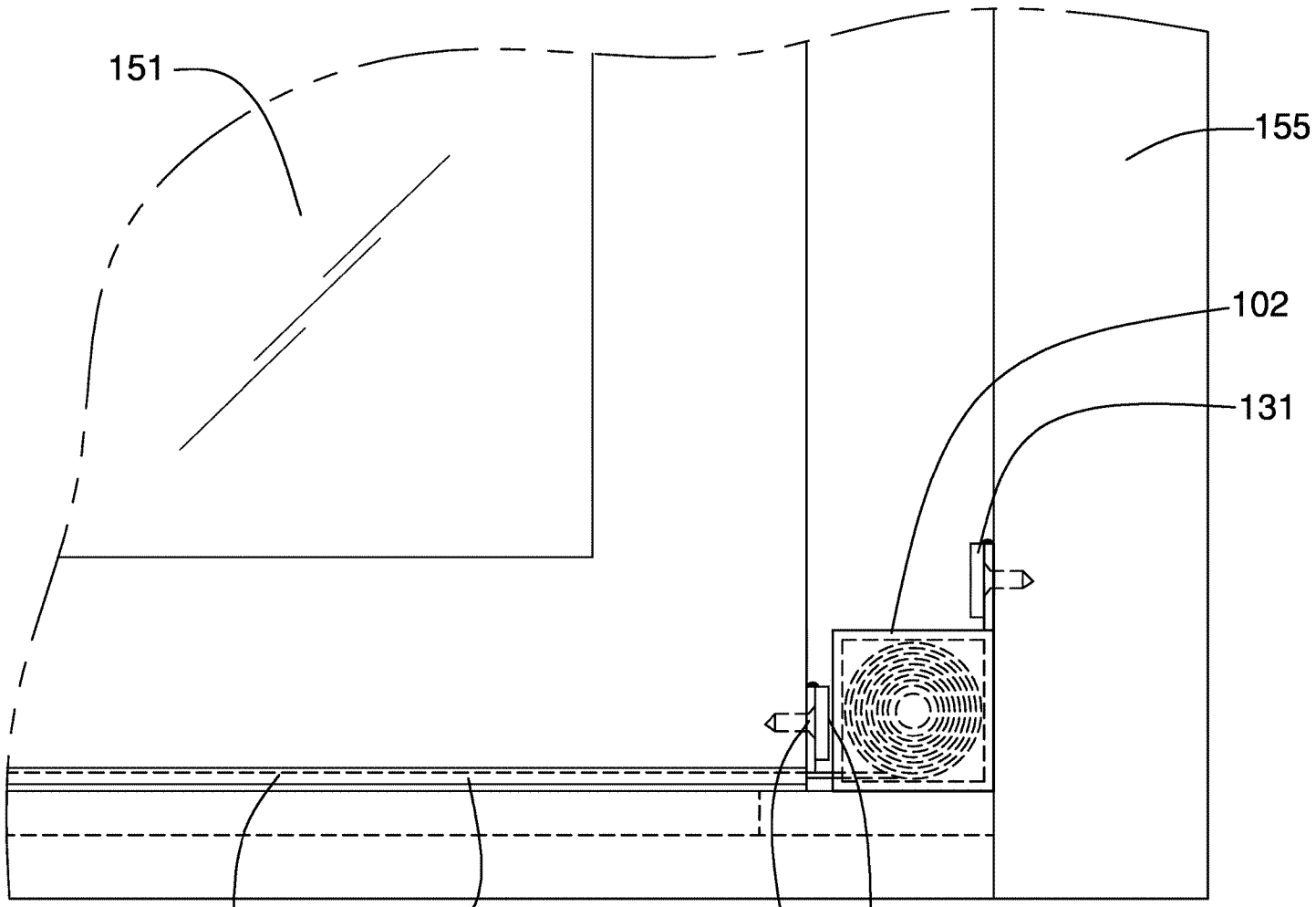
FIG. 3 is an in use view of an embodiment of the disclosure.
Figure 4:
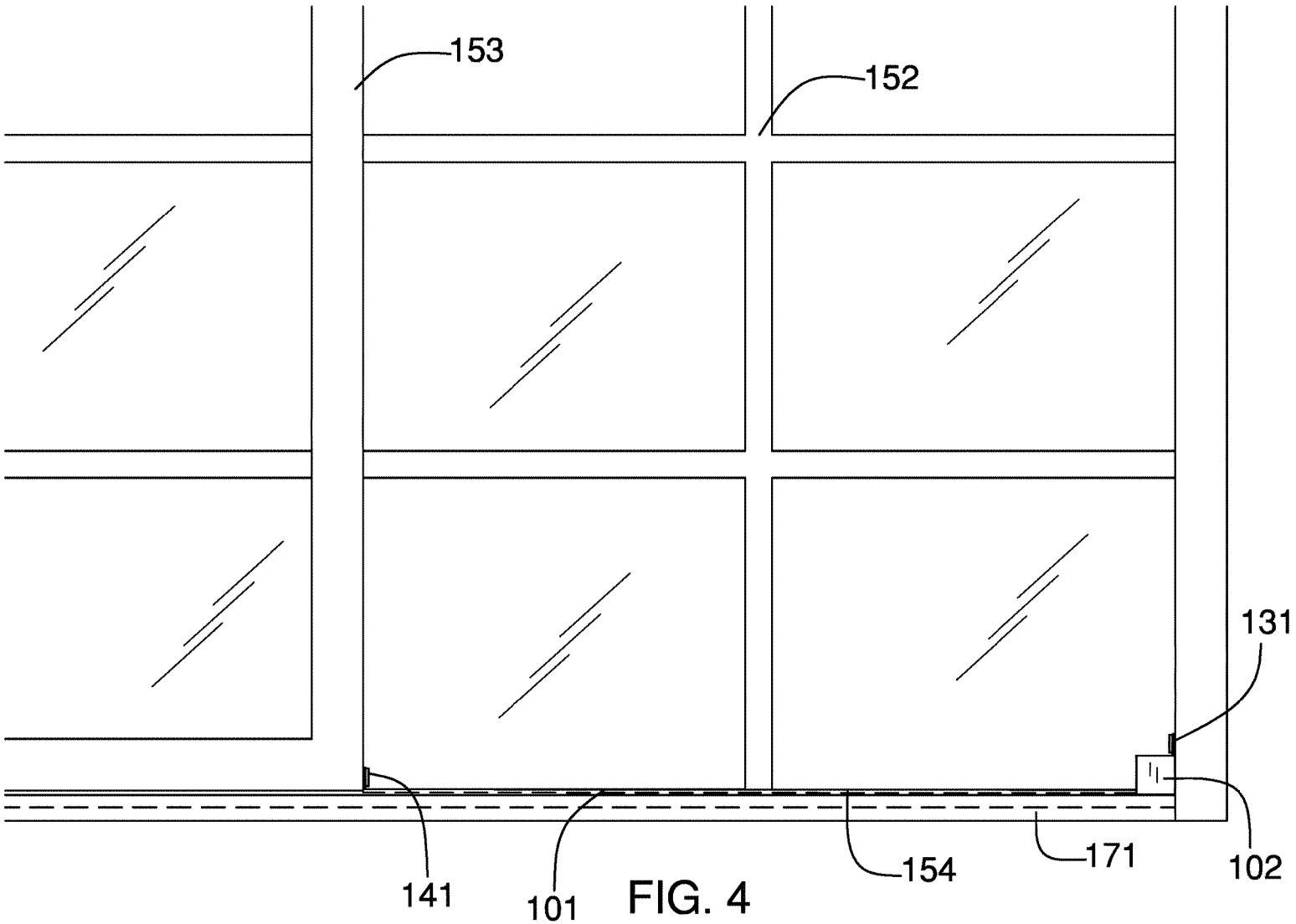
FIG. 4 is an in use view of an embodiment of the disclosure.
Figure 5:
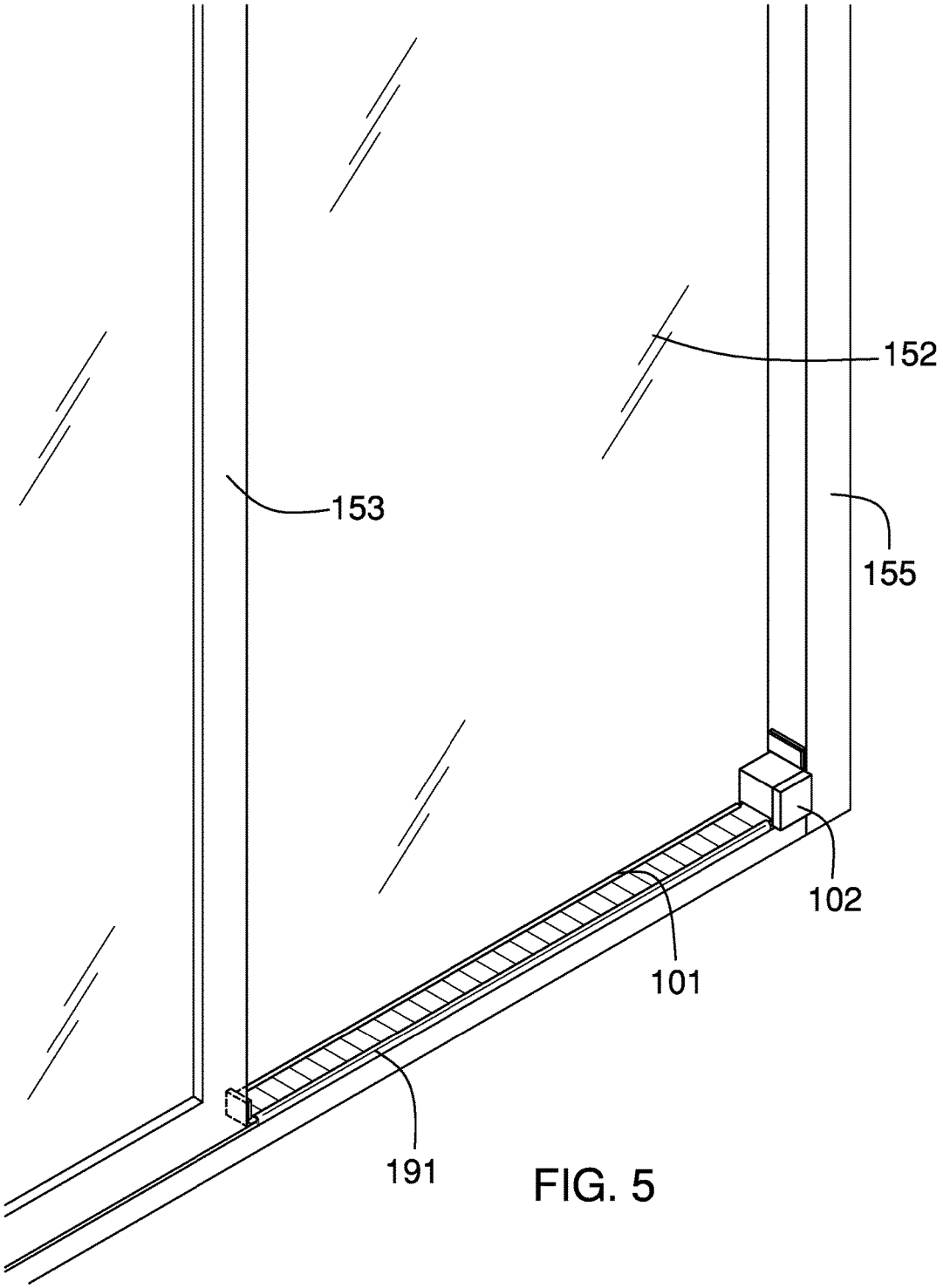
FIG. 5 is an in use view of an embodiment of the disclosure.
Figure 6:
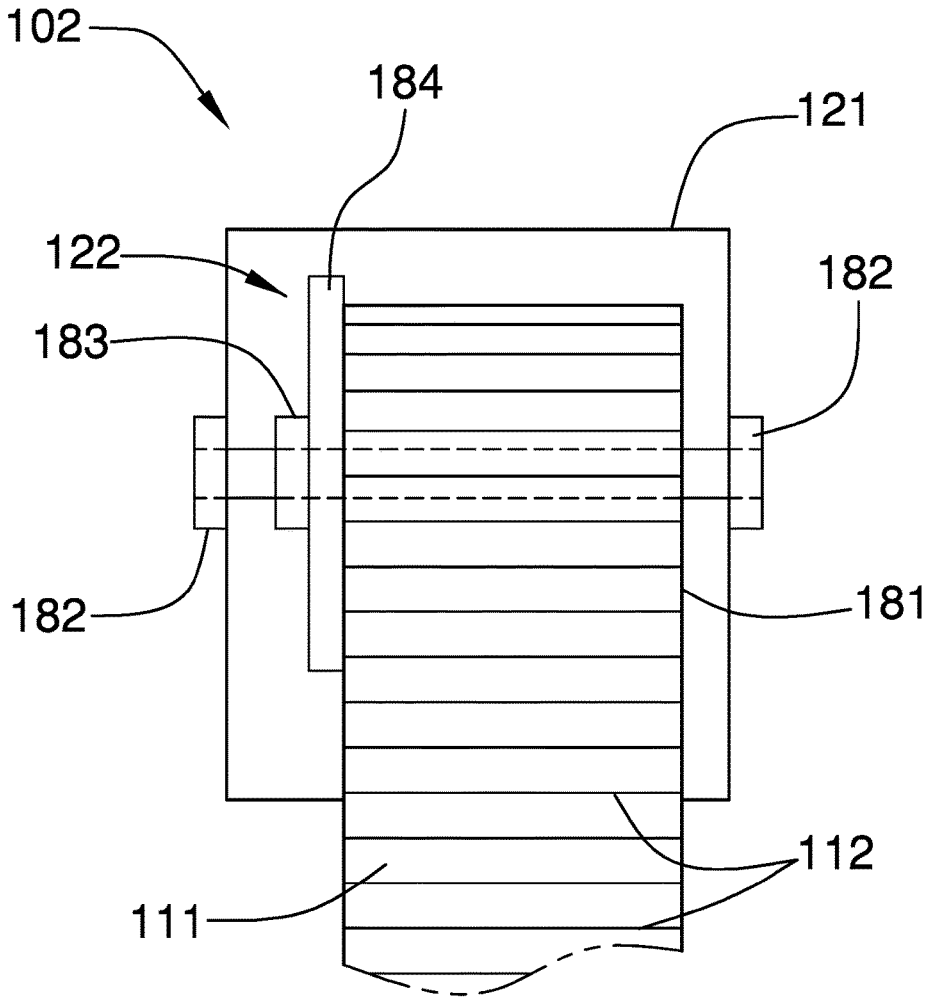
FIG. 6 is a detail view of an embodiment of the disclosure.

Detailed reference will now be made to one or more potential embodiments of the disclosure, which are illustrated in FIGS. 1 through 6.

The extendable track cover 100 (hereinafter invention) is configured for use with a sliding door 151. The sliding door 151 is further defined with a stationary wing 152, a sliding wing 153, a wing track 154, and a door frame 155. The sliding wing 153 moves in a linear fashion along a single dimension within the wing track 154. The invention 100 is a retractable structure that is a semi-rigid structure that protects the wing track 154 of the sliding door 151 when the sliding wing 153 is in the closed position. The invention 100 protects the wing from damage from refuse that may fall into the wing track 154 while the sliding door 151 is in the closed position. The retractable structure is retracted directly on to a spool 122 when the sliding door 151 is opened. The invention 100 comprises a cover 101 and a deployment mechanism 102. The cover 101 is a physical barrier that is positioned over the wing track 154 while the sliding wing 153 is in the closed position. The deployment mechanism 102: 1) retracts and stores the cover 101 when the sliding wing 153 is moved to the open position; and, 2) deploys the cover 101 back over the wing track 154 when the sliding wing 153 is returned to the closed position.

The sliding door 151 is a commercially available door. The stationary wing 152 is an immobile component of a sliding door 151 that forms a portion of the wall through which the sliding door 151 is installed. The sliding wing 153 is the mobile component of the sliding door 151. The sliding wing 153 moves in a direction that is parallel to the wall through which the sliding door 151 is installed. The wing track 154 is a track that is guides the direction of motion of the sliding wing 153. The door frame 155 is a rectangular frame that is built in the wall to accommodate the installation of the sliding door 151.

By open position is meant that the sliding wing 153 is positioned such that the sliding wing 153 is directly on top of the wing track 154. By closed position is meant that the sliding wing 153 is positioned such that the cover 101 is fully deployed over the wing track 154. It is the intention that these definitions match the vernacular usage of a door being open and closed.

The cover 101 is a barrier that is laid on top of the wing track 154 when the sliding door 151 is in a closed position. The cover 101 is a semi-rigid structure. The cover 101 is formed as a kerf bending such that the cover 101 may be spooled into the deployment mechanism 102 for storage. The kerf bending is discussed in greater detail elsewhere in this disclosure. The cover 101 attaches to the deployment mechanism 102 such that the cover 101 may be retracted into and deployed from the deployment mechanism 102. This arrangement between the cover 101 and the deployment mechanism 102 results in the cover 101 having a free end. The free end of the cover 101 is attached to the sliding wing 153 such that the sliding wing 153 will withdraw the cover 101 from the deployment mechanism 102 when the sliding wing 153 is placed in the closed position.

The cover 101 comprises a rigid plate 111 and a plurality of living hinges 112. The rigid plate 111 is a rectangular block structure that is formed as a strip. The rigid plate 111 is formed from as a semi-rigid structure with an elastic nature. The rigid plate 111 forms the physical barrier that protects the wing track 154. The plurality of living hinges 112 comprises a collection of notches that are formed in the rigid plate 111.

The kerf bending is formed using the plurality of living hinges 112. Each living hinge selected from the plurality of living hinges 112 is parallel to each of the living hinges remaining in the plurality of living hinges 112. The notch formed by each living hinge selected from the plurality of living hinges 112 is intended to increase the elasticity of the rigid plate 111 such that the rigid plate 111 can be bent at each notch to form a cant. In concert, the cant formed by each of the plurality of living hinges 112 can be individually adjusted to allow the rigid plate 111 to be spooled in a spiral fashion into the deployment mechanism 102. The tightness of the spiral formed by the rigid plate 111 can be adjusted by adjusting the spacing between each of the plurality of living hinges 112. In the first potential embodiment of the disclosure, the plurality of living hinges 112 are equally spaced along the rigid plate 111.

In a second potential embodiment of the disclosure, the cover further comprises a guide track 103. The cover 101 is guided along the wing track 154 by the guide track 103. The guide track 103 is positioned along the wing track 154 such that the guide track 103 forms a barrier that prevents the rigid plate 111 of the cover from moving off of the wing track 154. The guide track 103 comprises an inner rail 191 and an outer rail 192. The inner rail 191 is an L shaped structure that is suspended over a first edge of the rigid plate 111 as the rigid plate 111 is deployed over the wing track 154. The inner rail prevents the first edge of the rigid plate 111 from drifting beyond the edge of the wing track 154. The outer rail 192 is an L shaped structure that is suspended over a second edge of the rigid plate 111 as the rigid plate 111 is deployed over the wing track 154. The outer rail 192 prevents the first edge of the rigid plate 111 from drifting beyond the edge of the wing track 154.

The deployment mechanism 102 is a mechanical device that retracts and extends the cover 101 during normal use of the invention 100. The deployment mechanism 102 is a spring driven device. The deployment mechanism 102 spools the cover 101 into a housing 121 for storage when the sliding wing 153 is in the open position. The deployment mechanism 102 is anchored to the door frame 155. The deployment mechanism 102 comprises a housing 121, a spool 122, a stationary mounting plate 123, and a sliding mounting plate 124.

The housing 121 is further defined with an inferior surface 161, a superior surface 162, a frame surface 163, a wing surface 164, an exterior surface 165, and an interior surface 166. The inferior surface 161 is the surface of the housing 121 that is proximal to the supporting surface 171 during normal use of the invention 100. The superior surface 162 is the surface of the housing 121 that is distal from the inferior surface 161. The frame surface 163 is the surface of the housing 121 that is proximal to the door frame 155 during normal use of the invention 100. The wing surface 164 is the surface of the housing 121 that is distal from the frame surface 163. The exterior surface 165 is the surface of the housing 121 that is proximal to the stationary wing 152 during normal use of the invention 100. The interior surface 166 is the surface of the stationary mounting plate 123 that is distal from the exterior surface 165.

The housing 121 is a casing within which the spool 122 and the rigid plate 111 are contained. The housing 121 is formed with all necessary apertures and form factors necessary to allow the housing 121 to accommodate the use and operation of the invention 100. The housing 121 further comprises a cover aperture 126. The cover aperture 126 is a slot that accommodates the movement of the rigid plate 111 into and out of the shell formed by the housing 121. Methods to form slots in shells are well known in the mechanical arts.

The spool 122 is a cylindrical device upon which the rigid plate 111 is spooled for storage when the sliding wing 153 is in the open position. The spool 122 is a spring driven device. The spool 122 comprises a drum 181, a drum mount 182, a ratchet 183, and a mainspring 184.

The drum 181 is a right cylindrical structure upon which the rigid plate 111 is spooled. The drum mount 182 is a mechanical structure that attaches the drum 181 to the housing 121 such that the drum 181 rotates such that the center of rotation of the drum 181 is aligned with the center axis of the drum 181. The ratchet 183 is a well-known mechanism that locks the drum 181 in a fixed position when the rigid plate 111 is deployed. The mainspring 184 is a commercially available coiled ribbon spring that is placed under tension when the sliding wing 153 is in the closed position. The energy released when the mainspring 184 returns to its relaxed shape is used to retract the rigid plate 111 into the housing 121. Methods to design and manufacture a spool 122 comprising a drum 181, a drum mount 182, a ratchet 183, and a mainspring 184 are well known and documented in the mechanical arts.

The stationary mounting plate 123 is a structure which is used to anchor the housing 121 of the deployment mechanism 102 to the door frame 155. The stationary mounting plate 123 comprises a stationary attachment plate 131, a stationary cover 132, a stationary hinge 133, and a plurality of stationary mounting holes 134. The stationary attachment plate 131 is further defined with a first mounting surface 167. The first mounting surface 167 is the surface of the stationary attachment plate 131 that is proximal to the door frame 155.

The stationary attachment plate 131 is a rectangular plate that is attached to the superior surface 162 of the housing 121. The stationary cover 132 is a rectangular plate that is attached to the stationary attachment plate 131. The stationary cover 132 is a decorative structure that masks the plurality of stationary mounting holes 134. The stationary hinge 133 attaches the stationary cover 132 to the stationary attachment plate 131 such that the stationary cover 132 rotates relative to the stationary attachment plate 131. In the first potential embodiment of the disclosure, the stationary hinge 133 is a living hinge. Each of the plurality of stationary mounting holes 134 is a hole formed through the stationary attachment plate 131. The plurality of stationary mounting holes 134 are used to screw the stationary attachment plate 131 into the door frame 155.

The sliding mounting plate 124 is a structure which is used to attach the free end of the rigid plate 111 to the sliding wing 153. The sliding mounting plate 124 attaches the rigid plate 111 to the sliding wing 153 such that: 1) the sliding wing 153 will extend the rigid plate 111 when the sliding wing 153 is moved to the closed position; and, 2) the rigid plate 111 will be retracted into the housing 121 when the sliding wing 153 is moved into the open position. The sliding mounting plate 124 comprises a sliding attachment plate 141, a sliding cover 142, a sliding hinge 143, and a plurality of sliding mounting holes 144. The sliding attachment plate 141 is further defined with a second mounting surface 168. The second mounting surface 168 is the surface of the sliding attachment plate 141 that is proximal to the sliding wing 153.

The sliding attachment plate 141 is a rectangular plate that is attached to the sliding wing 153. The sliding cover 142 is a rectangular plate that is attached to the sliding attachment plate 141. The sliding cover 142 is a decorative structure that masks the plurality of sliding mounting holes 144. The sliding hinge 143 attaches the sliding cover 142 to the sliding attachment plate 141 such that the sliding cover 142 rotates relative to the sliding attachment plate 141. In the first potential embodiment of the disclosure, the sliding hinge 143 is a living hinge. Each of the plurality of sliding mounting holes 144 is a hole formed through the sliding attachment plate 141. The plurality of sliding mounting holes 144 are used to screw the sliding attachment plate 141 into the sliding wing 153.

Further details regarding the assembly and installation of the invention 100 are described in this paragraph. The cover 101 is contained within the deployment mechanism 102. The cover 101 is wound on a drum 181 that is contained within the housing 121. The stationary attachment plate 131 attaches to the superior surface 162 of the housing 121 such that: 1) the stationary attachment plate 131 projects away from the superior surface 162; and, 2) the first mounting surface 167 and the superior surface 162 forms a single planar surface along the edge formed where the superior surface 162 and the frame surface 163 join. The cover aperture 126 is formed in the wing surface 164 of the housing 121 such that the cover aperture 126 is parallel to the edge of the housing 121 that is formed by the inferior surface 161 and the wing surface 164.

Definitions and Directional References

Anchor: As used in this disclosure, anchor means to hold an object firmly or securely.

Anchor Point: As used in this disclosure, an anchor point is a location to which a first object can be securely attached to a second object.

Cant: As used in this disclosure, a cant is an angular deviation from one or more reference planes such as a vertical plane or a horizontal plane.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Center of Rotation: As used in this disclosure, the center of rotation is the point of a rotating plane that does not move with the rotation of the plane. A line within a rotating three dimensional object that does not move with the rotation of the object is also referred to as an axis of rotation.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Drum: Refers to a right circular cylinder or spool shaped object. The diameter of the drum refers to distance across the circular face of the drum. The circumference of the drum refers to the distance around the edge of the circular face of the drum. The length of the drum refers to the distance between the circular faces of the drum.

Drum Mount: Refers to the method that holds the drum in its operating position. As used here, the drum mount is designed to allow for the rotation of the drum and, optionally, may provide a connection to the drive.

Elastic: As used in this disclosure, an elastic is a material or object that deforms when a force is applied to it and that is able to return to its original shape after the force is removed. A material that exhibits these qualities is also referred to as an elastomeric material.

Flexure Bearing: As used in this disclosure, a flexure bearing is a thin and flexible material that is used to attach, or bind, a first object to a second object such that the first object can rotate in a controlled direction relative to the second object.

Form Factor: As used in this disclosure, the term form factor refers to the size and shape of an object.

Hinge: As used in this disclosure, a hinge is a device that permits the turning, rotating, or pivoting of a first object relative to a second object.

Housing: As used in this disclosure, a housing is a rigid casing that encloses and protects one or more devices. L Track Fastener: As used in this disclosure, an L track fastener is a fastening device that is used to attach a first object to a second object by sliding the first object on to the second object. The L track fastener further comprises a rail and a channel. The rail is an L shaped projection that is attached to the first object and the channel is attached to the second object such that the first object is attached to the second object when the rail is inserted into the channel.

Living Hinge: As used in this disclosure, refers to a single object that is formed out of elastomeric material that is divided into a first segment, a second segment and the living hinge. The elastic nature of the elastomeric material allow the living hinge to be flexed in the manner of a hinge allowing the first segment to rotate relative to the second hinge. The living hinge is a form of a flexure bearing. A material that is formed with a series of parallel living hinges is referred to as a kerf bending. A kerf bending formed in a plate allows the plate to be bent into a curved shape.

Mainspring: As used in this disclosure, a mainspring is a spiral torsion spring made of a metal ribbon. Energy is stored in a mainspring by twisting the spiral tighter. Mainsprings are commonly found in watches. Mainsprings are also commonly referred to as coiled ribbon springs or coiled flat springs.

Notch: As used in this disclosure, a notch is: 1) an indentation formed in an edge; or 2) a cavity or aperture formed within a surface.

Pivot: As used in this disclosure, a pivot is a rod or shaft around which an object rotates or swings.

Ratchet: As used in this disclosure, a ratchet is a device comprising a pawl or hinged catch that engages the sloping teeth of a wheel or bar permitting motion in one direction only.

Rectangular Block: As used in this disclosure, a rectangular block refers to a three dimensional structure comprising six rectangular surfaces formed at right angles.

Within this disclosure, a rectangular block may further comprises rounded edges and corners.

Relaxed Shape: As used in this disclosure, a structure is considered to be in its relaxed state when no shear, strain, or torsional forces are being applied to the structure.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Slot: As used in this disclosure, a slot is a long narrow groove or aperture that is formed in an object.

Spiral: As used in this disclosure, a spiral describes a locus of points within a plane moving around a fixed center wherein the locus of points moves monotonically increasing manner away from the center.

Spool: As used in this disclosure, a spool is a cylindrical device upon which a flexible material, including but not limited to a yarn, a cord, or a tape, can be wound.

Depending on context, a spool may also contain the flexible material stored upon the spool.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Strip: As used in this disclosure, the term describes a long thin object of uniform width. Strips are often rectangular blocks in shape.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Track: As used in this disclosure, a track is a device that is used to control the path of motion of an object in at least one dimension and in a maximum of two dimensions.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An accessory for a sliding door comprising:
a cover and a deployment mechanism;
wherein the cover has a free end;
wherein the accessory is used with the sliding door;
wherein the sliding door is further defined with a stationary wing, a sliding wing, a wing track, and a door frame;
wherein the sliding wing moves along the wing track;
wherein the cover covers the wing track of the sliding door when the sliding wing is in a closed position;
wherein the cover is stored in the deployment mechanism when the sliding wing is in an opened position;
wherein the deployment mechanism comprises a housing, a spool, a stationary mounting plate, and a sliding mounting plate;
wherein the spool is contained within the housing;
wherein the stationary mounting plate is attached to the housing;
wherein the sliding mounting plate is attached to the sliding wing;
wherein the housing is further defined with an inferior surface, a superior surface, a frame surface, a wing surface, an exterior surface, and an interior surface;
wherein the spool comprises a drum, a drum mount, a ratchet, and a mainspring;
wherein the drum, the ratchet and the mainspring are attached to the drum mount;
wherein the drum mount attaches the spool to the housing.

2. The accessory for a sliding door according to claim 1
wherein the cover is a physical barrier;
wherein the cover is on top of the wing track when the sliding wing is in the closed position.

3. The accessory for a sliding door according to claim 2 wherein the cover attaches to the deployment mechanism.

4. The accessory for a sliding door according to claim 3
wherein the cover comprises a plate and a plurality of living hinges;
wherein the plurality of living hinges are formed in the cover.

5. The accessory for a sliding door according to claim 4
wherein the cover is a strip;
wherein the cover protects the wing track when the sliding wing is in the closed position.

6. The accessory for a sliding door according to claim 5 wherein a kerf bending is formed using the plurality of living hinges;

wherein each of the plurality of living hinges is a notch formed in the cover;

wherein each said living hinge selected from the plurality of living hinges is parallel to each of the living hinges remaining in the plurality of living hinges.

7. The accessory for a sliding door according to claim 6 wherein a cant formed by each of the plurality of living hinges allows the cover to be spooled into the deployment mechanism.

8. The accessory for a sliding door according to claim 7 wherein the plurality of living hinges are equally spaced along the cover.

9. The accessory for a sliding door according to claim 8 wherein the deployment mechanism is anchored to the door frame.

10. The accessory for a sliding door according to claim 9 wherein the spool and the cover are contained in the housing;

wherein the housing further comprises a slot that accommodates movement of the cover into and out of the housing.

11. The accessory for a sliding door according to claim 10 wherein the drum is a cylindrical device upon which the cover is spooled for storage when the sliding wing is in the opened position.

12. The accessory for a sliding door according to claim 11 wherein the drum is a right cylindrical structure;

wherein the drum mount is a mechanical structure that attaches the drum to the housing such that the drum is rotatable with a center of rotation of the drum aligned with a center axis of the drum.

13. The accessory for a sliding door according to claim 12 wherein the ratchet is adapted to lock the drum in a fixed position;

wherein the mainspring is a ribbon spring that is placed under tension when the sliding wing is in the closed position.

14. The accessory for a sliding door according to claim 13 wherein the stationary mounting plate anchors the housing of the deployment mechanism to the door frame;

wherein the stationary mounting plate comprises a stationary attachment plate, a stationary cover, a stationary hinge, and a plurality of stationary mounting holes;

wherein the stationary hinge attaches the stationary cover to the stationary attachment plate;

wherein the plurality of stationary mounting holes are formed in the stationary attachment plate;

wherein the stationary attachment plate is further defined with a first mounting surface.

15. The accessory for a sliding door according to claim 14 wherein the sliding mounting plate is a structure which is used to attach the free end of the cover to the sliding wing;

wherein the sliding mounting plate comprises a sliding attachment plate, a sliding cover, a sliding hinge, and a plurality of sliding mounting holes;

wherein the sliding attachment plate attaches to the sliding wing;

wherein the sliding hinge attaches the sliding cover to the sliding attachment plate;

wherein each of the plurality of sliding mounting holes is a hole formed through the sliding attachment plate.

16. The accessory for a sliding door according to claim 15 wherein the stationary attachment plate is a rectangular plate that is attached to the superior surface of the housing;

wherein the stationary cover is a rectangular plate that is attached to the stationary attachment plate;

wherein the stationary hinge attaches the stationary cover to the stationary attachment plate such that the stationary cover is rotatable relative to the stationary attachment plate;

wherein the stationary hinge is a living hinge;

wherein each of the plurality of stationary mounting holes is a hole formed through the stationary attachment plate;

wherein the sliding attachment plate is further defined with a second mounting surface;

wherein the sliding attachment plate is a rectangular plate that is attached to the sliding wing;

wherein the sliding cover is a rectangular plate that is attached to the sliding attachment plate;

wherein the sliding hinge attaches the sliding cover to the sliding attachment plate such that the sliding cover is rotatable relative to the sliding attachment plate;

wherein the sliding hinge is a living hinge.

17. The accessory for a sliding door according to claim 16 wherein the deployment mechanism further comprises a guide track;

wherein the guide track further comprises an inner rail and an outer rail;

wherein the inner rail is an L shaped structure that is suspended over a first edge of the cover when the sliding wing is in the closed position;

wherein the outer rail is an L shaped structure that is suspended over a second edge of the cover when the sliding wing is in the closed position.

* * * * *